US011619150B2

(12) United States Patent
Sperry

(10) Patent No.: US 11,619,150 B2
(45) Date of Patent: Apr. 4, 2023

(54) LUBRICATION FLUID STORAGE SYSTEM WITH VENTING

(71) Applicant: Cummins Inc., Columbus, IN (US)

(72) Inventor: Robert G. Sperry, Columbus, IN (US)

(73) Assignee: Cummins Inc., Columbus, IN (US)

( * ) Notice: Subject to any disclaimer, the term of this patent is extended or adjusted under 35 U.S.C. 154(b) by 49 days.

(21) Appl. No.: 17/335,712

(22) Filed: Jun. 1, 2021

(65) Prior Publication Data

US 2022/0381168 A1 Dec. 1, 2022

(51) Int. Cl.
*F01M 11/00* (2006.01)

(52) U.S. Cl.
CPC . *F01M 11/0004* (2013.01); *F01M 2011/0041* (2013.01); *F01M 2011/0066* (2013.01)

(58) Field of Classification Search
CPC ..... F01M 11/0004; F01M 2011/0041; F01M 2011/0066; F01M 13/0011; F01M 2011/033; F01M 13/04; F01M 2013/0433; F02B 75/20; B01D 45/08; B01D 45/16; F16K 15/16
See application file for complete search history.

(56) References Cited

U.S. PATENT DOCUMENTS

| | | | | |
|---|---|---|---|---|
| 1,674,103 | A | 6/1928 | Fredrick | |
| 1,989,816 | A | 3/1932 | Meyer | |
| 1,866,280 | A | 7/1932 | Woolson | |
| 3,590,953 | A | 7/1971 | Wellauer | |
| 4,825,825 | A | 5/1989 | Chino et al. | |
| 5,568,842 | A | 10/1996 | Otani | |
| 5,887,563 | A | 3/1999 | Shudo et al. | |
| 6,199,543 | B1 | 3/2001 | Bedkowski | |
| 7,270,105 | B2 | 9/2007 | Furuya | |
| 8,578,906 | B2 | 11/2013 | Yamada et al. | |
| 9,157,348 | B2 | 10/2015 | Hodges | |
| 10,184,370 | B2 * | 1/2019 | Odo | F01M 9/101 |
| 10,947,872 | B1 | 3/2021 | Augustin | |
| 11,242,779 | B1 * | 2/2022 | Vant Hoff | F01M 1/02 |
| 2004/0112677 | A1 | 6/2004 | Ito et al. | |
| 2011/0067669 | A1 | 3/2011 | Sugiyama et al. | |
| 2013/0014726 | A1 | 1/2013 | Yamada et al. | |
| 2016/0265404 | A1 | 9/2016 | Fujii et al. | |
| 2017/0356315 | A1 | 12/2017 | Miyasaka et al. | |
| 2019/0032527 | A1 | 1/2019 | May et al. | |
| 2019/0107031 | A1 | 4/2019 | Christensen et al. | |
| 2019/0120369 | A1 | 4/2019 | Staake et al. | |

FOREIGN PATENT DOCUMENTS

| | | | |
|---|---|---|---|
| CN | 207437245 | * | 6/2018 |

* cited by examiner

*Primary Examiner* — Syed O Hasan
(74) *Attorney, Agent, or Firm* — Taft, Stettinius & Hollister LLP

(57) ABSTRACT

A storage reservoir for an internal combustion engine is provided that includes a plurality of vents connected to an air compartment that outlets air from the storage reservoir. The storage reservoir can remain vented to supply of lubrication fluid even if the internal combustion engine is inclined due to operation along severe grades.

19 Claims, 5 Drawing Sheets

LUBRICATION FLUID STORAGE SYSTEM WITH VENTING

STATEMENT REGARDING FEDERALLY SPONSORED RESEARCH

This Project Agreement Holder (PAH) invention was made with U.S. Government support under Agreement No. W15QKN-14-9-1002 awarded by the U.S. Army Contracting Command-New Jersey (ACC-NJ) Contracting Activity to the National Advanced Mobility Consortium. The Government has certain rights in the invention.

FIELD OF THE INVENTION

This invention relates to an internal combustion engine including a lubrication system, and more particularly to a lubrication fluid storage system that is vented.

BACKGROUND

The cylinders and other components in an internal combustion engine require lubrication by oil or other suitable fluid to be able to operate properly. For vehicles operating over steep inclines and other severe grade conditions, the ability of the crank case to supply lubrication fluid may be compromised. Furthermore, engine packaging requirements may require engine configurations which further exasperate these issues, and may create additional issues such as flooding by the lubrication fluid while operating on severe inclines or grades. Therefore, further improvements in lubrication fluid storage and delivery are needed.

SUMMARY

Embodiments include an internal combustion engine including a lubrication fluid storage system that is at least partially separated from the crankcase to provide effective management and supply of the lubrication fluid even while operating at severe inclines or grades, such as at grades greater than 50%. The lubrication fluid storage system includes an upper storage reservoir and a lower storage reservoir that are connected to one another via at least two passages through a block of the engine so that a supply of lubrication fluid remains available for distribution to the engine components regardless of the angular orientation of the engine due to operation over a severe incline or grade.

In one embodiment, the upper storage reservoir includes at least one fluid return pocket and at least one air return pocket connected to receive air and lubrication fluid from air/fluid separator(s). The upper storage reservoir also includes an air outlet for venting air from the upper storage reservoir, and a plurality of vents connected to the air outlet. The connection of the plurality of vents is configured so that at least one of the plurality of events is not flooded with lubrication fluid over severe grades or inclines.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION OF ILLUSTRATIVE EMBODIMENTS

Figure 1:
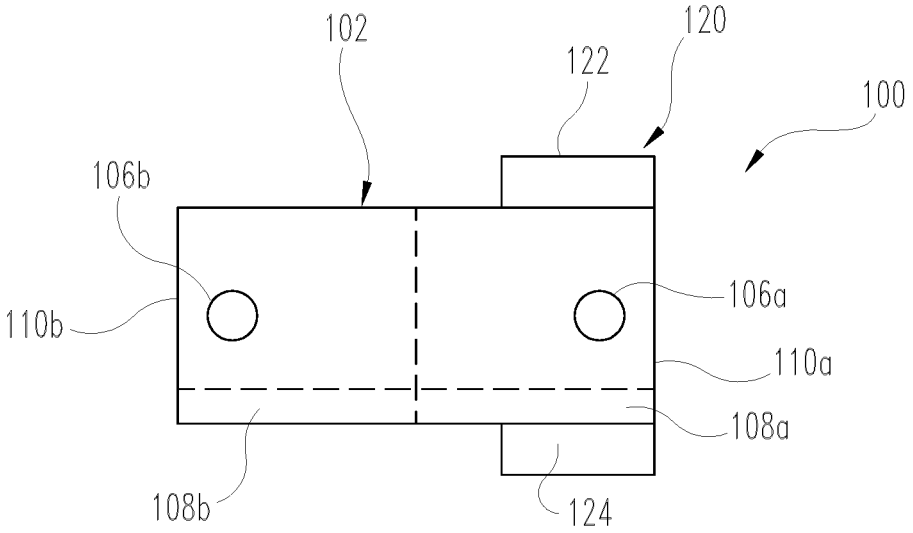
FIG. 1 is a schematic depiction of an end view of a vehicle system including an internal combustion engine and a lubrication fluid storage system.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Figure 2:
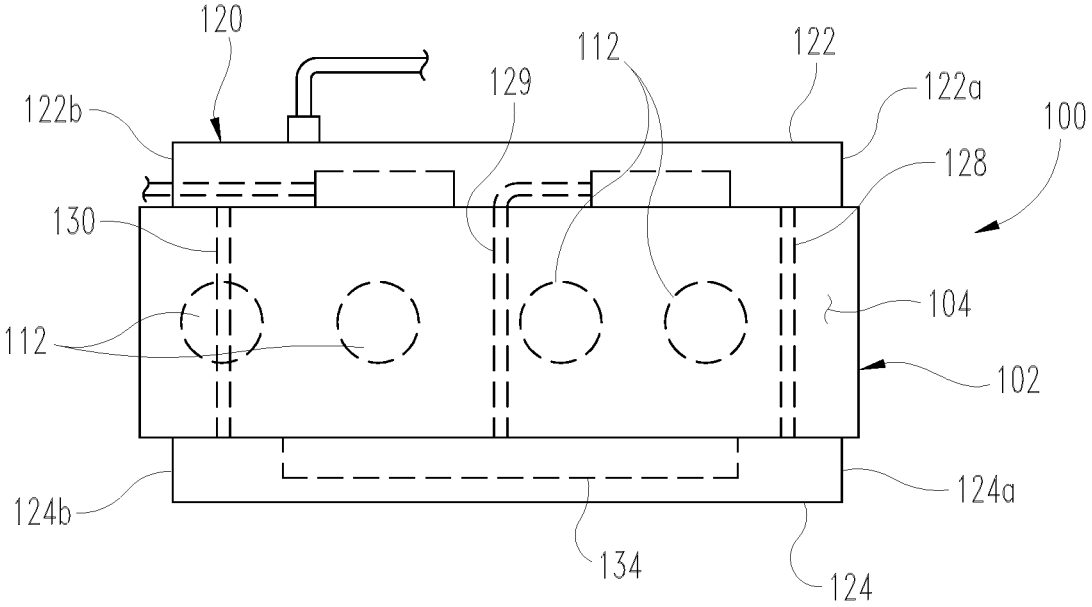
FIG. 2 is a schematic depiction of a side view of the internal combustion engine and the on-engine lubrication fluid storage system of FIG. 1.

Referring to FIGS. 1-2, a vehicle system 100 includes an internal combustion engine 102 with a block 104 housing a plurality of components such as crankshafts 106*a*, 106*b*, a plurality of cylinders 112, and one or more crankcases 108*a*, 108*b* associated with respective ones of the one or more cylinder banks 110*a*, 110*b*. Other components are also contemplated but not illustrated, such as pistons, gears, pumps, housings, turbines, etc. that would normally be found on an internal combustion engine. The vehicle system 100 further includes a lubrication fluid storage system 120 that is mounted on-engine to receive lubrication fluid, such as oil, from at least one of the first and second crankcases 108*a*, 108*b* and to return the lubrication fluid to the plurality of components for lubrication and/or cooling.

The internal combustion engine 102 may be coupled to a transmission (not shown), which may be a part of a powertrain for propelling a vehicle driven by engine 102 via wheels, tracks, etc. The engine 102 may be any type of internal combustion engine that requires lubrication, including at least a diesel, gasoline, or natural gas engine, and/or combinations thereof. The internal combustion engine 102 may propel the vehicle, or may provide power that is used by other means, such as an electric drive, that propels the vehicle. In the illustrated embodiment of FIGS. 1-2, the vehicle system 100 includes an internal combustion engine 102 having a dual cylinder bank with first and second cylinder banks 110*a*, 110*b* that each includes four (4) horizontally oriented cylinders 112 for illustration purposes only. However, other numbers of cylinders and cylinder arrangements, including engines with a single cylinder bank, and other horizontal, vertical, or inclined cylinder arrangements, are also contemplated for internal combustion engine 102.

Figure 3:
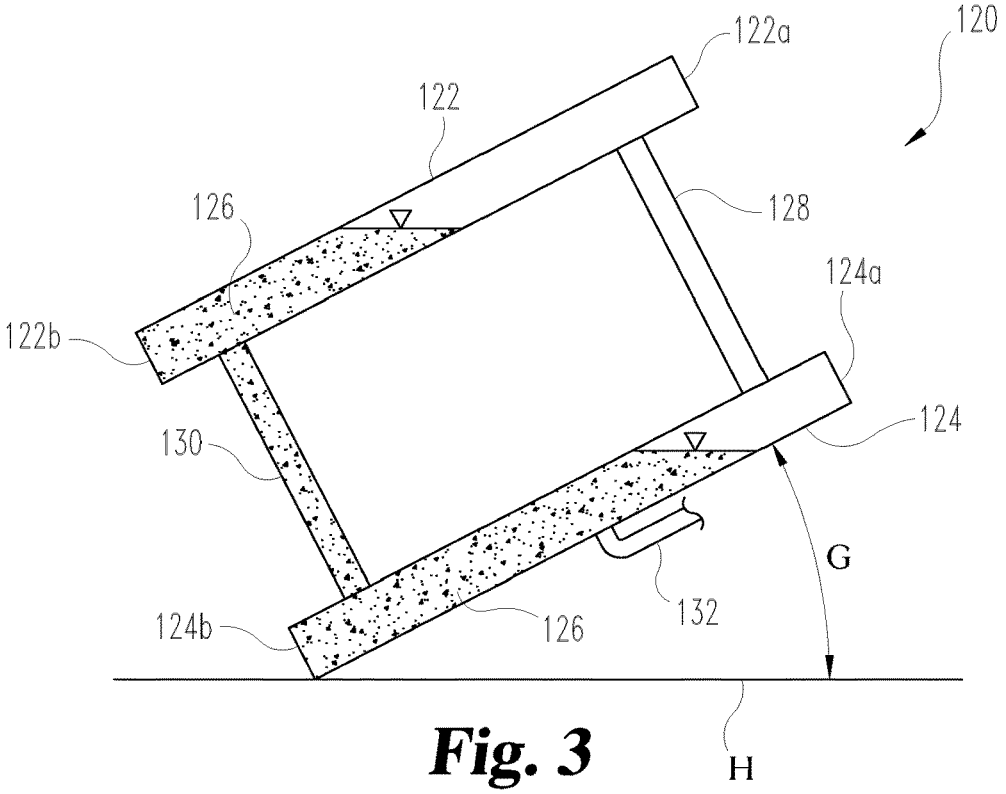
FIG. 3 is a schematic depiction of a side view of the lubrication fluid storage system tilted on a grade.

The lubrication fluid storage system 120 includes, in the illustrated embodiment, an upper storage reservoir 122 and a lower storage reservoir 124 for storing lubrication fluid 126 (FIG. 3.) Upper storage reservoir 122 can be mounted directly or indirectly on an upper surface of engine block 104 and receives lubrication fluid from one or both of crankcases 108*a*, 108*b* to provide a supply of lubrication fluid to lower storage reservoir 124. Lower storage reservoir 124 can be mounted directly or indirectly on a bottom of engine block 104 and receives lubrication fluid from upper storage reservoir 122. Lubrication fluid 126 is distributed from lower storage reservoir 125 to the engine components. Upper and lower storage reservoirs 122, 124 are located on one side of engine 102, such as adjacent to a lateral edge of the side of block 104 housing cylinder bank 110*a*. Other embodiments contemplate that upper and lower storage reservoirs 122, 124 are located on the other side of block 104 housing cylinder bank 110*b*, or located on a side of a block 103 that just includes a single cylinder bank. In still other embodiments, a single storage reservoir 122 is provided that is vented in the manner described herein to maintain the supply of lubrication fluid under severe grade conditions.

A number of passages 128, 129, 130 are provided through engine block 104 to connect upper storage reservoir 122 with lower storage reservoir 124 to provide the lubrication fluid to or from lower reservoir 124. In the illustrated embodiment, each of the reservoirs 122, 124 is elongated between opposite ends 122*a*, 122*b* and opposite ends 124*a*, 124*b*, respectively. The direction of elongation extends in the rearward-forward direction of the internal combustion engine 102, i.e. in the direction of travel of the vehicle system 100. First passage 128 is located or offset toward or adjacent to ends 122*a*, 124*a* of reservoirs 122, 124. In addition, another passage, such as third passage 130, is located or offset toward or adjacent to ends 122*b*, 124*b* of reservoirs 122, 124. Other embodiments contemplate that one or two passages, or more than three passages, are provided to connect reservoirs 122, 124.

As shown in FIG. 3, the arrangement of passages 128, 130 at or adjacent the ends of the storage volumes 122, 124 allows one of the passages 128, 130 to remain in contact with or submerged in the lubrication fluid 126 even if the vehicle system 100 operates along an incline or grade G that deviates substantially from horizontal grade H. Therefore, a constant supply of lubrication fluid from upper storage reservoir 122 can be maintained to lower storage reservoir 124 even at severe grades G up to and greater than 50%. In one embodiment, the passages 128, 130 are arranged to provide a continuous supply of lubrication fluid to lower storage reservoir 124 at grades G up to 65%. The lower storage reservoir 124 includes a lubrication fluid outlet 132 that is therefore always maintained with a supply of lubrication fluid 126 that is supplied to lower storage reservoir 124 for distribution to the plurality of components of the internal combustion engine 102.

Figure 4:
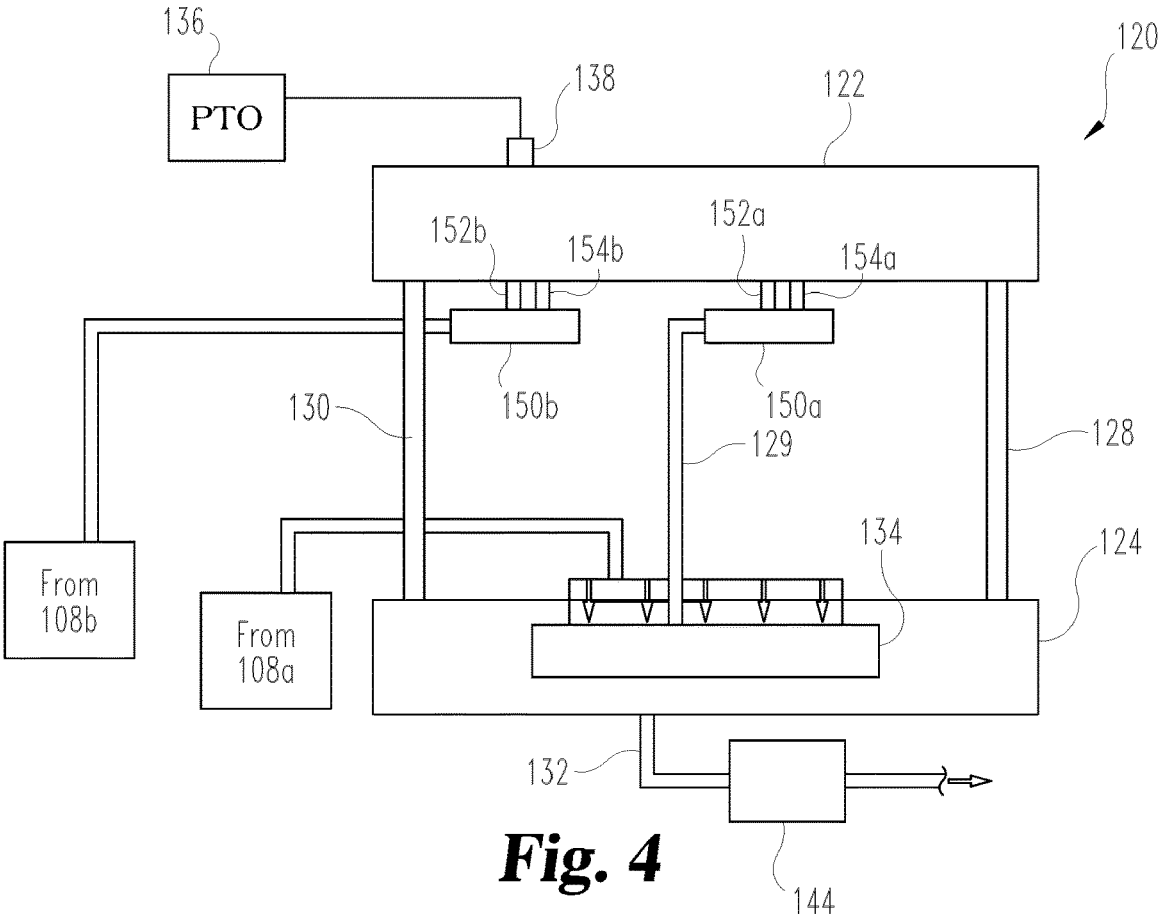
FIG. 4 is a schematic depiction of further aspects of the lubrication fluid storage system of FIG. 1.

Referring to FIG. 4, the lower storage reservoir 124 includes a scavenge pump 134 housed therein that receives the fluid from the crankcase 108*a* and/or components of cylinder bank 110*a*, such as the cylinders 112 and gear and turbine housings. The scavenge pump 134 can be mounted directly to the underside of engine block 103 to receive the lubrication fluid from the engine components while being fluidly isolated from lower storage reservoir 124. Scavenge pump 134 is connected to an air/fluid separator 150*a* adjacent to or under the upper storage reservoir 122 with the third passage 129 that extends through block 104. If provided, the second crankcase 108*b* can provide lubrication fluid to a second air/fluid separator 150*b* adjacent to or under the upper reservoir 122, either via scavenge pump 134 or another scavenge pump connected to air/fluid separator 150*b*.

The returned lubrication fluid 126 from the engine components and/or crankcase 108*a*, 108*b* is pumped by scavenge pump(s) 134 to pass through the air/fluid separator(s) 150*a*, 150*b* so that the separated lubrication fluid can be returned to and stored in upper storage reservoir 122, as described further below. Air/fluid separators 150*a*, 150*b* include corresponding fluid outlets 152*a*, 152*b* connected to respective fluid return pockets of upper storage reservoir 122. Air/fluid separators 150*a*, 150*b* also include corresponding air outlets 154*a*, 154*b* connected to respective air return pockets of upper storage reservoir 122. The returned air separated by the air/fluid separator(s) 150*a*, 150*b* is outlet from upper storage reservoir 122 to an apparatus 136 such as a power take-off (PTO) housing or a breather, via an air outlet 138 connected to an air compartment of upper storage reservoir 122. The returned and separated fluid is provided from upper storage reservoir 122 to lower storage reservoir 124 through one or both passages 128, 130. The lubrication fluid 126 in lower storage reservoir 124 is provided via a lubrication fluid outlet 132 to a lubrication fluid pump 144 for circulation to the plurality of components of engine 102.

Figure 5:
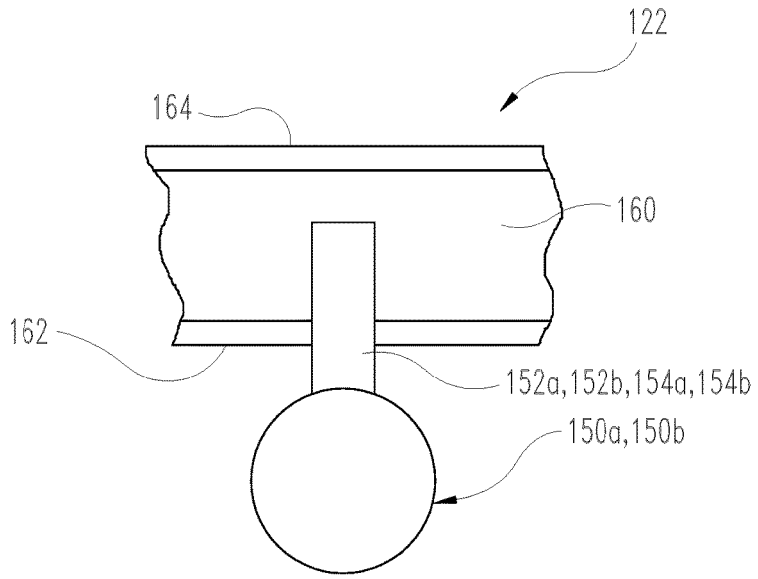
FIG. 5 is a schematic diagram of a connection of an air/fluid separator to the upper storage reservoir.

Referring to FIG. 5, as discussed above, air/fluid separators 150*a*, 150*b* include fluid outlets 152*a*, 152*b* and air outlets 154*a*, 154*b*, respectively, connected to upper storage reservoir 122. The outlets 152*a*, 152*b*, 154*a*, 154*b* can extend into interior 160 of upper storage reservoir 122 at the aligned fluid or air return pocket 200*a*, 200*b*, 202*a*, 202*b* within upper storage reservoir 122. The outlets 152*a*, 152*b*, 154*a*, 154*b* can include tubular members that are slip fit into openings in the bottom wall 162 of upper storage reservoir 122. The outlets that are located above the bottom wall 162 and below the upper wall 164 of upper storage reservoir 122 so as to provide fluid or air return at a location positioned above the normal, non-inclined fluid running level in interior 160.

Figure 6:
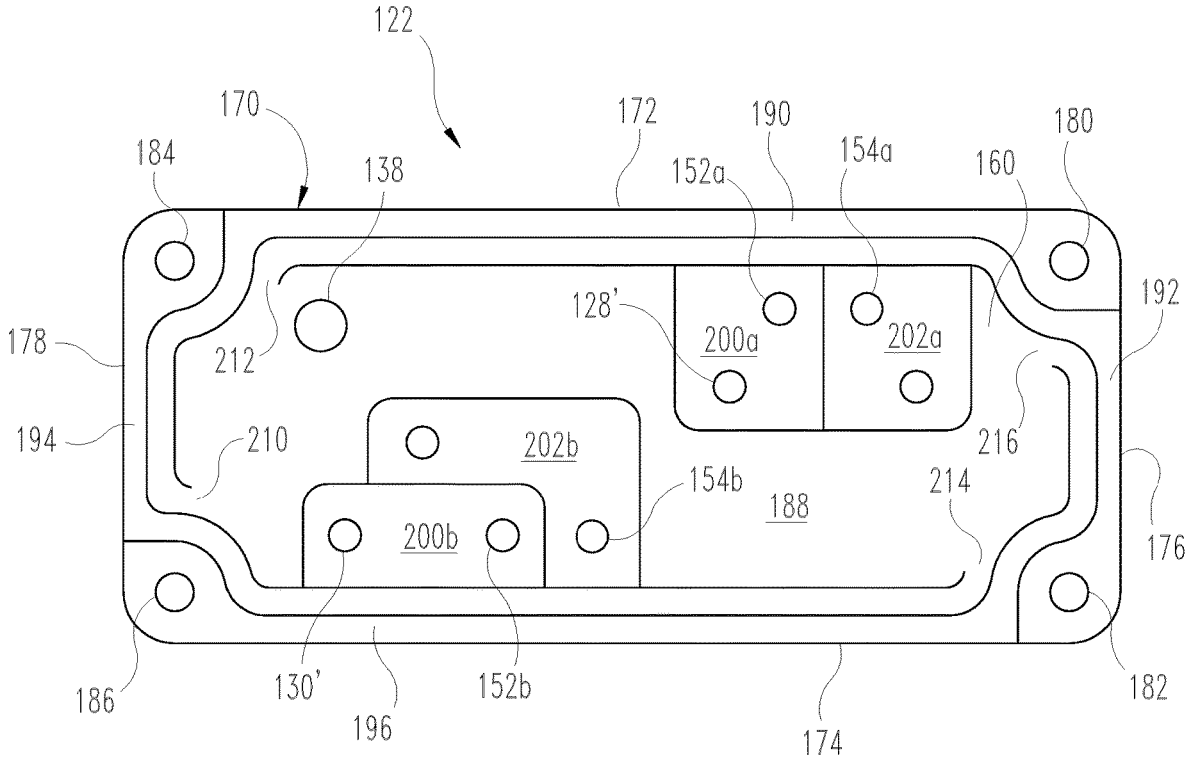
FIG. 6 is a schematic diagram of an embodiment of an interior of the upper storage reservoir.

Referring now to FIG. 6, there is shown a top schematic view of the interior 160 of upper storage reservoir 122. Interior 160 is formed by a housing 170 that includes a first elongated side 172 and a second elongated side 174. First and second elongated sides 172, 174 extend between a first end 176 and an opposite second end 178 that extend between the sides 172, 174. In the illustrated embodiment, housing 170 includes a rectangular shape formed by sides 172, 174 and ends 176, 178. However, non-rectangular shapes are also contemplated. The fluid return pockets 200*a*, 200*b* and air return pockets 202*a*, 202*b* are located in housing 170 within interior 160.

A plurality of vents 180, 182, 184, 186 are provided at distributed locations about the interior 160 to ensure proper venting for flow of fluid from upper storage reservoir 122 to lower storage reservoir 124 through outlets 128', 130' connected to corresponding ones of the passages 128, 130. In the illustrated embodiment, a first vent 180 is located adjacent the intersection of first end 176 and first side 172, a second vent 182 is located adjacent the intersection of first end 176 and second side 174, a third vent 184 is located adjacent the intersection of second end 178 and first side 172, and a fourth vent 186 is located adjacent the intersection of second end 178 and second side 174. Other embodiments contemplate other locations of vents 180, 182, 184, 186 and/or more or fewer than four vents, so long as at least one of the vents remains unflooded in response to upper reservoir 122 being sloped or inclined.

Vents 180, 182, 184, 186 are in fluid communication with an air compartment 188 in interior 160 of housing 170. Air compartment 188 is fluidly isolated from the lubrication fluid return pockets 200*a*, 200*b* of upper storage reservoir 122. Air compartment 188 is fluidly connected to the air outlet 138. The air compartment 188 is also fluidly connected to each of the plurality of vents 180, 182, 184, 186 with respective ones of a plurality of vent passages 190, 192, 194, 196, at least when upper storage reservoir 122 is operating on a horizontal grade.

In the illustrated embodiment, the first vent passage 190 connects the first vent 180 to the air compartment 188. The first vent passage 190 extends from the first vent 180 along the first side 172 toward the second end 178, and along the second end 178 to a first outlet 210 to the air compartment 188. The second vent passage 192 connects the second vent 182 to the air compartment 188. The second vent passage 192 extends from the second vent 182 along the first end 176 toward the first side 172, and along the first side 172 toward the second end 178 to a second outlet 212 to the air compartment 188. The third vent passage 194 connects the third vent 184 to the air compartment 188. The third vent passage 194 extends from the third vent 184 along the second end 178 toward the second side 174, and along the second side 174 toward the first end 176 to a third outlet 214 to the air compartment 188. The fourth vent passage 196 connects the fourth vent 186 to the air compartment 188. The fourth vent passage 196 extends from the fourth vent 186 along the second side 174 toward the first end 176, and along the first end 176 toward the first side 172 to a fourth outlet 216 to the air compartment 188.

Figure 7A:
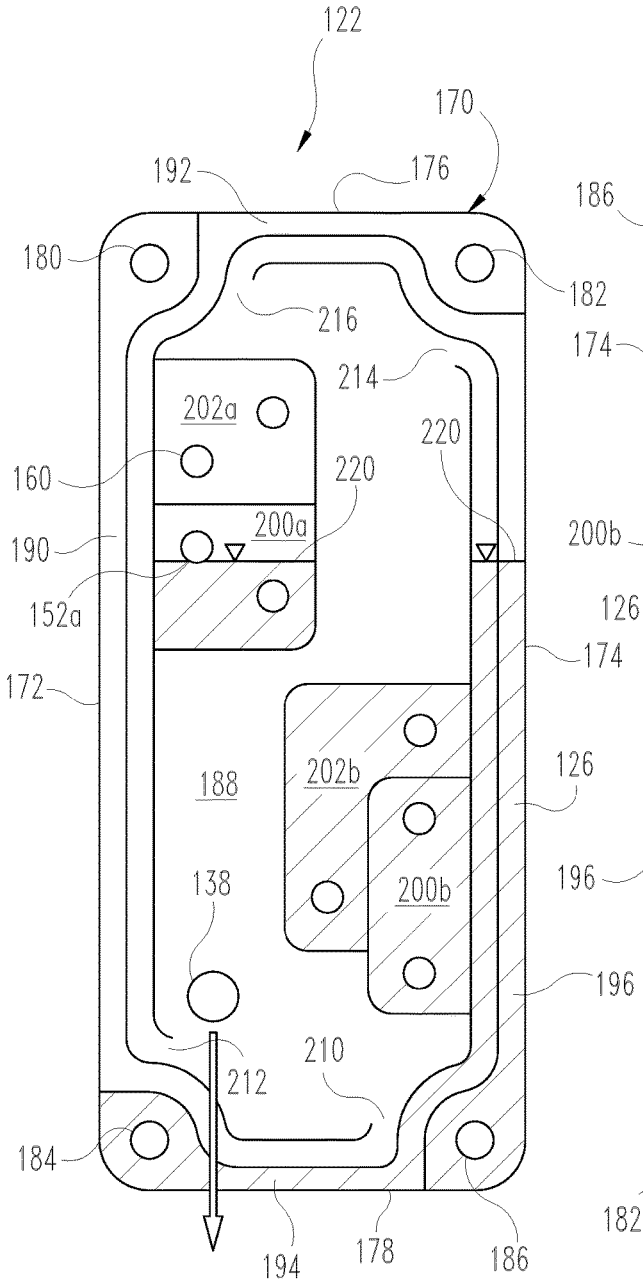
FIGS. 7A and 7B are schematic diagrams of the fluid displacement in the interior of the upper storage reservoir with the internal combustion engine tilted front up and rear up, respectively.
Figure 7B:
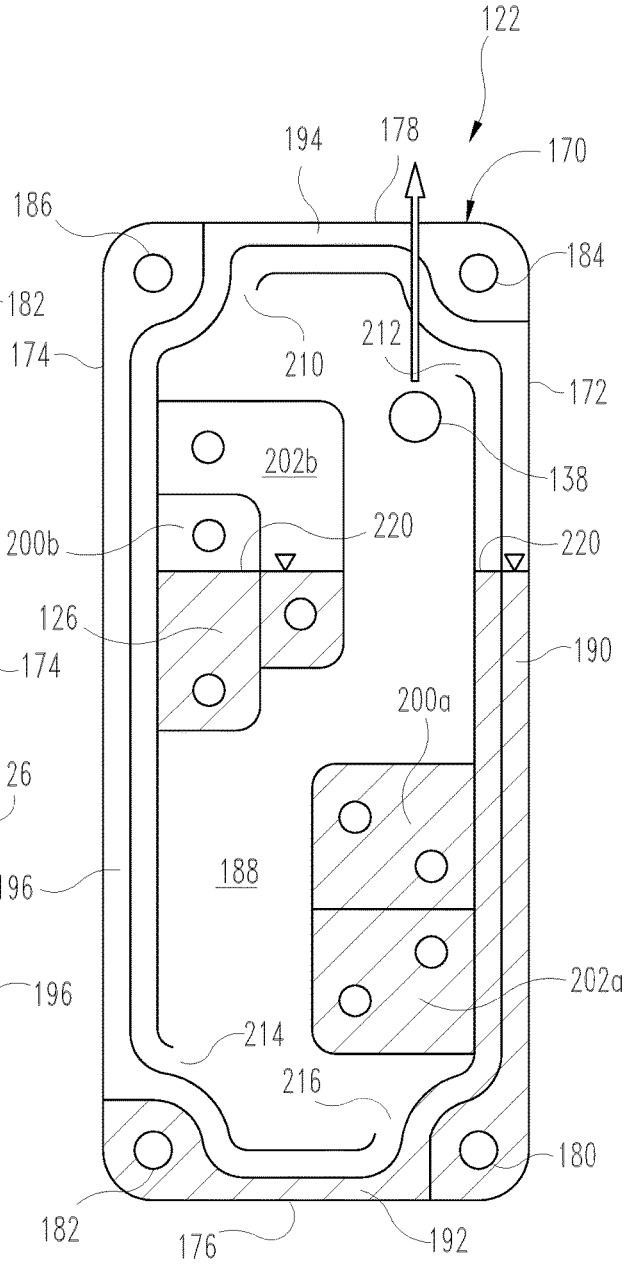

Referring to FIGS. 7A and 7B, upper storage reservoir 122 is shown in a flooded condition due to a front end (FIG. 7A) or a rear end (FIG. 7B) of the engine/vehicle being at a severe incline. The level 220 of the lubrication fluid 126 in the flooded pockets and passages is shown in cross-hatching, while air compartment 188 remains unflooded due to being isolated from the flooded pockets via the arrangement of vent passages 190, 192, 194, 196. In particular, the arrangement of vent passages 190, 192, 194, 196 positions the locations of their respective outlets 210, 212, 214, 216 such that air compartment 188 is prevented from being flooded when one or more, but not all, of the vents 180, 182, 184, 186 is flooded.

In particular, in FIG. 7A the vents 184, 186 and connected vent passages 194, 196 are flooded. However, vents 180, 182 and their respective vent passages 190, 192 remain unflooded and connected to air compartment 188 to provide a venting function for the flow of lubrication fluid to the lower storage reservoir 124. This is due to the outlets 214, 216 of flooded vent passages 194, 196 being located above the level 220 of the lubrication fluid 126. In FIG. 7B the vents 180, 182 and the connected vent passages 190, 192 are flooded with lubrication fluid due to the inclined grade. However, vents 184, 186 and their respective vent passages 194, 196 remain unflooded and connected to air compartment 188 to provide a venting function for the flow of lubrication fluid to the lower storage reservoir 124. This is due to the outlets 210, 212 of flooded vent passages 190, 192 being located above the level 220 of the lubrication fluid 126.

Figure 8:
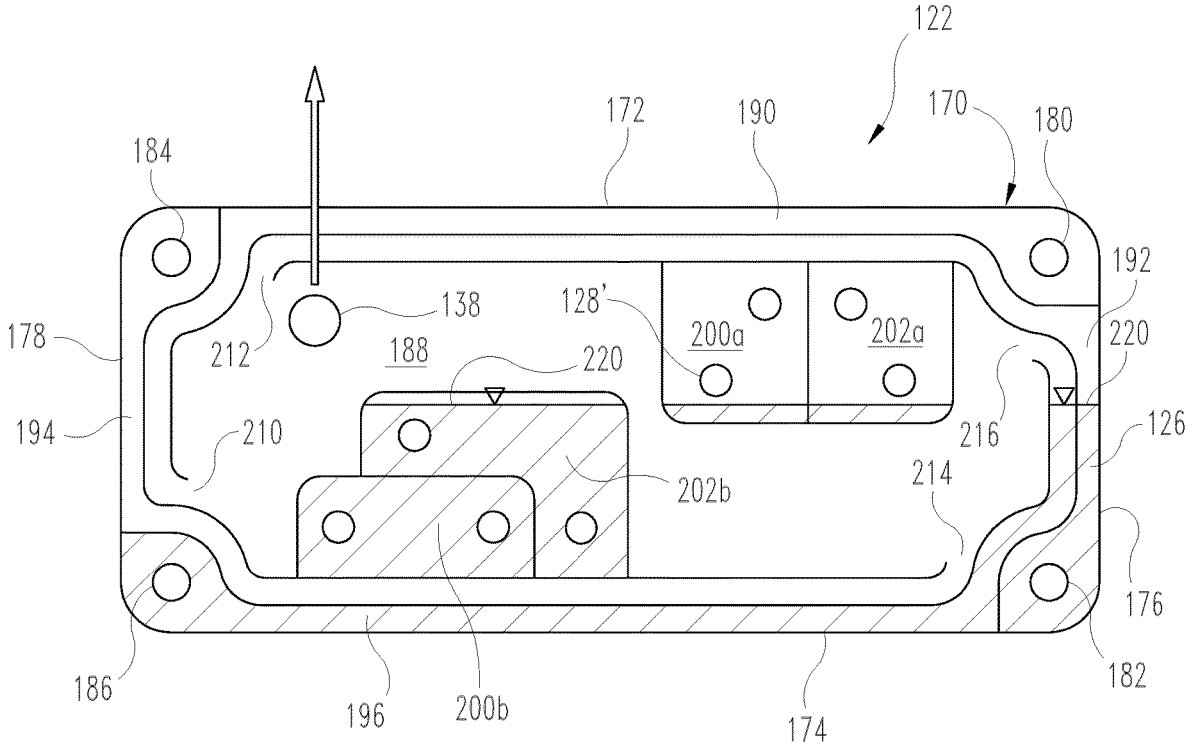
FIG. 8 is a schematic diagram of the fluid displacement in the interior of the upper storage reservoir with the internal combustion engine tilted to one side.

FIG. 8 shows a sideways inclined arrangement for the upper storage reservoir. In FIG. 8 the vents 182, 186 and connected vent passages 192, 196 are flooded. However, vents 180, 184 remain connected to air compartment 188 via their respective vent passages 190, 194, which remain unflooded and operable to vent air to air passage 188. An incline in the opposite sideways direction similarly allows vents 182, 186 to provide venting while vents 180, 184 are flooded. The arrangement of vents 180, 182, 184, 186 and their respective vent passages 190, 192, 194, 196 ensure venting of upper storage reservoir 122 is provided by at least one vent 180, 182, 184, 186 at all compound angularity conditions of the engine/vehicle during operation over severe grades, even if some of the vents 180, 182, 184, 186 are flooded. The air compartment 188 remains isolated from the lubrication fluid under all running conditions and grades, which prevents fluid leak down even if the vehicle is parked on a severe grade.

Although four vents are shown at the corners of housing 170, other arrangements and locations of vents 180, 182, 184, 186 are contemplated so long as at least one vent and its respective vent passage can remain non-flooded and connected to air compartment 188 for venting when one or more other vents are flooded. This is accomplished by vent passages 190, 192, 194, 196 being arranged so that at least one vent passage 190, 192, 194, 196 extends above the flooded fluid level to its respective outlet 210, 212, 214, 216 into the air compartment 188. In addition, although housing 170 is shown is shown with fluid return pockets 200*a*, 200*b* and air return pockets 202*a*, 202*b*, such pockets can be eliminated in other embodiments of the storage reservoir contemplated herein.

Various aspects of the present disclosure are contemplated as indicated in the claims appended hereto. According one aspect, a system includes an internal combustion engine for a vehicle. The internal combustion engine includes a block, a plurality of components supported by the block, and a lubrication fluid for lubricating the plurality of components. A lubrication fluid storage system is provided for storing a supply of the lubrication fluid to lubricate the plurality of components. The lubrication fluid storage system includes at least one reservoir for receiving the lubrication fluid collected from the plurality of components and for providing lubrication fluid to the plurality of components. The storage reservoir includes an air outlet connected to a plurality of vents that are located around the storage reservoir so that the air outlet remains unflooded while at least one of the plurality of vents is flooded with lubrication fluid in response to tilting of the storage reservoir.

In an embodiment, at least one of the plurality of vents remains unflooded in response to the storage reservoir being tilted at a grade of at least 50%. In an embodiment, the air outlet is connected to at least one of a power take-off and a breather of the internal combustion engine In an embodiment, at least one return passage extends through the block for returning lubrication fluid to the storage reservoir. In an embodiment, the at least one return passage is connected to an air/fluid separator located below the storage reservoir. In an embodiment, the air/fluid separator includes a fluid connection for returning separated lubrication fluid to a fluid return pocket of the storage reservoir and an air connection for outputting separated air to an air return pocket of the storage reservoir. In an embodiment, the air/fluid separator receives lubrication fluid from a first crankcase of the internal combustion engine. A second air/fluid separator is located below the storage reservoir for receiving lubrication fluid from a second crankcase of the internal combustion engine.

In an embodiment, the storage reservoir includes a first end, a second end opposite the first end, a first side, and a second side opposite the first side, the first and second sides connecting the first and second ends. The plurality of vents includes a first vent adjacent a connection of the first end and the first side, a second vent adjacent a connection of the first end and the second side, a third vent adjacent a connection of the second end and the first side, and a fourth vent adjacent a connection of the second end and the second side.

In an embodiment, the storage reservoir includes an air compartment connected to the air outlet, and the air compartment is connected to each of the plurality of vents with respective ones of a plurality of vent passages. In an embodiment, the plurality of vent passages includes a first vent passage connecting the first vent to the air compartment. The first vent passage extends from the first vent along the first side toward the second end, and along the second end to a first outlet into the air compartment. The plurality of vent passages also includes a second vent passage connecting the second vent to the air compartment. The second vent passage extends from the second vent along the first end toward the first side, and along the first side toward the second end to a second outlet into the air compartment. The plurality of vent passages also includes a third vent passage connecting the third vent to the air compartment. The third vent passage extends from the third vent along the second end toward the second side, and along the second side toward the first end to a third outlet into the air compartment. The plurality of vent passages also includes a fourth vent passage connecting the fourth vent to the air compartment. The fourth vent passage extends from the fourth vent along the second side toward the first end, and along the first end toward the first side to a fourth outlet into the air compartment.

In an embodiment, the storage reservoir is an upper storage reservoir and the lubrication fluid storage system includes a lower storage reservoir connected to the upper storage reservoir. The lower storage reservoir is for storing the lubrication fluid to circulate to the plurality of components of the internal combustion engine;

According to another aspect, a lubrication system for an internal combustion engine includes a storage reservoir for providing lubrication fluid to the internal combustion engine. The storage reservoir includes an air compartment connected to an air outlet for removing air from the storage reservoir and a plurality of vents connected to the air compartment via respective ones of a plurality of vent passages.

In an embodiment, the storage reservoir is connected to a lower storage reservoir. In an embodiment, at least one air/fluid separator is connected between the lower storage reservoir and the storage reservoir. In an embodiment, the air/fluid separator includes a fluid connection for returning separated lubrication fluid to a fluid return pocket of the storage reservoir and an air connection for outputting separated air to an air return pocket of the storage reservoir.

In an embodiment, the storage reservoir includes a first end, a second end opposite the first end, a first side, and a second side opposite the first side, the first and second sides connecting the first and second ends. The plurality of vents includes a first vent adjacent a connection of the first end and the first side, a second vent adjacent a connection of the first end and the second side, a third vent adjacent a connection of the second end and the first side, and a fourth vent adjacent a connection of the second end and the second side. In an embodiment, the storage reservoir includes an air compartment connected to the air outlet, and the air compartment is connected to each of the plurality of vents with respective ones of a plurality of vent passages.

In an embodiment, the plurality of vent passages includes a first vent passage connecting the first vent to the air compartment. The first vent passage extends from the first vent along the first side toward the second end, and along the second end to a first outlet into the air compartment. The plurality of vent passages also includes a second vent passage connecting the second vent to the air compartment. The second vent passage extends from the second vent along the first end toward the first side, and along the first side toward the second end to a second outlet into the air compartment. The plurality of vent passages also includes a third vent passage connecting the third vent to the air compartment. The third vent passage extends from the third vent along the second end toward the second side, and along the second side toward the first end to a third outlet into the air compartment. The plurality of vent passages also includes a fourth vent passage connecting the first vent to the air compartment. The fourth vent passage extends from the fourth vent along the second side toward the first end, and along the first end toward the first side to a fourth outlet into the air compartment.

In an embodiment, a first air/fluid separator and a second air fluid separator are each connected to the storage reservoir. In an embodiment, the first air/fluid separator includes a first fluid connection for returning separated lubrication fluid to a first fluid return pocket of the storage reservoir and a first air connection for outputting separated air to a first air return pocket of the storage reservoir. The second air/fluid separator includes a second fluid connection for returning separated lubrication fluid to a second fluid return pocket of the storage reservoir and a second air connection for outputting separated air to a second air return pocket of the storage reservoir.

In an embodiment, the vents of the plurality of vents are located adjacent respective ones of a plurality of corners of the storage reservoir.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

an internal combustion engine for a vehicle, the internal combustion engine including a block, a plurality of components supported by the block, and a lubrication fluid for lubricating the plurality of components;

a lubrication fluid storage system for storing a supply of the lubrication fluid to lubricate the plurality of components, the lubrication fluid storage system including a storage reservoir for receiving the lubrication fluid collected from the plurality of components and for providing lubrication fluid for circulation to the plurality of components, wherein the storage reservoir includes an air outlet connected to a plurality of vents that are located around the storage reservoir and the air outlet is fluidly isolated from the lubrication fluid in the storage reservoir so that the air outlet remains unflooded while at least one of the plurality of vents is flooded with lubrication fluid in response to tilting of the storage reservoir.

2. The system of claim 1, wherein at least one of the plurality of vents remains unflooded in response to the storage reservoir being tilted at a grade of at least 50%.

3. The system of claim 1, further comprising at least one return passage through the block for returning lubrication fluid to the storage reservoir.

4. The system of claim 3, wherein the at least one return passage is connected to an air/fluid separator located below the storage reservoir.

5. A system, comprising:

an internal combustion engine for a vehicle, the internal combustion engine including a block, a plurality of components supported by the block, and a lubrication fluid for lubricating the plurality of components;

a lubrication fluid storage system for storing a supply of the lubrication fluid to lubricate the plurality of components, the lubrication fluid storage system including a storage reservoir for receiving the lubrication fluid collected from the plurality of components and for providing lubrication fluid for circulation to the plurality of components, wherein the storage reservoir includes an air outlet connected to a plurality of vents that are located around the storage reservoir so that the air outlet remains unflooded while at least one of the plurality of vents is flooded with lubrication fluid in response to tilting of the storage reservoir; and an air/fluid separator below the storage reservoir, the air/fluid separator including a fluid connection for returning separated lubrication fluid to a fluid return pocket of the storage reservoir and an air connection for outputting separated air to an air return pocket of the storage reservoir.

6. The system of claim 4, wherein the air/fluid separator receives lubrication fluid from a first crankcase of the internal combustion engine and further comprising a second air/fluid separator located below the storage reservoir for receiving lubrication fluid from a second crankcase of the internal combustion engine.

7. The system of claim 1, wherein the air outlet is connected to at least one of a power take-off and a breather of the internal combustion engine.

8. The system of claim 1, wherein:

the storage reservoir includes a first end, a second end opposite the first end, a first side, and a second side opposite the first side, the first and second sides connecting the first and second ends; and the plurality of vents includes a first vent adjacent a connection of the first end and the first side, a second vent adjacent a connection of the first end and the second side, a third vent adjacent a connection of the second end and the first side, and a fourth vent adjacent a connection of the second end and the second side.

9. The system of claim 8, wherein the storage reservoir includes an air compartment connected to the air outlet, and the air compartment is connected to each of the plurality of vents with respective ones of a plurality of vent passages.

10. The system of claim 9, wherein the plurality of vent passages includes:

a first vent passage connecting the first vent to the air compartment, the first vent passage extending from the first vent along the first side toward the second end, and along the second end to a first outlet into the air compartment;

a second vent passage connecting the second vent to the air compartment, the second vent passage extending from the second vent along the first end toward the first side, and along the first side toward the second end to a second outlet into the air compartment;

a third vent passage connecting the third vent to the air compartment, the third vent passage extending from the third vent along the second end toward the second side, and along the second side toward the first end to a third outlet into the air compartment; and a fourth vent passage connecting the fourth vent to the air compartment, the fourth vent passage extending from the fourth vent along the second side toward the first end, and along the first end toward the first side to a fourth outlet into the air compartment.

11. The system of claim 1, wherein the storage reservoir is an upper storage reservoir located on an upper surface of the block and the lubrication fluid storage system further includes a lower storage reservoir located on a bottom of the block, the lower storage reservoir connected to the upper storage reservoir, the lower storage reservoir for storing the lubrication fluid to circulate to the plurality of components of the internal combustion engine.

12. A lubrication system for an internal combustion engine, comprising: a storage reservoir for providing lubrication fluid to the internal combustion engine, the storage reservoir including an air compartment connected to an air outlet for removing air from the storage reservoir and a plurality of vents connected to the air compartment via respective ones of a plurality of vent passages, the plurality of vent passages being configured so the air outlet is fluidly isolated from lubrication fluid in the storage reservoir to remain unflooded while any of the plurality of vents is flooded with lubrication fluid in response to tilting of the storage reservoir.

13. The system of claim 12, wherein the storage reservoir is connected to a lower storage reservoir.

14. The system of claim 13, further comprising at least one air/fluid separator connected between the lower storage reservoir and the storage reservoir.

15. The system of claim 14, wherein the air/fluid separator includes a fluid connection for returning separated lubrication fluid to a fluid return pocket of the storage reservoir and an air connection for outputting separated air to an air return pocket of the storage reservoir.

16. The system of claim 12, wherein:

the storage reservoir includes a first end, a second end opposite the first end, a first side, and a second side opposite the first side, the first and second sides connecting the first and second ends; and the plurality of vents includes a first vent adjacent a connection of the first end and the first side, a second vent adjacent a connection of the first end and the second side, a third vent adjacent a connection of the second end and the first side, and a fourth vent adjacent a connection of the second end and the second side.

17. The system of claim 16, wherein the plurality of vent passages includes:

a first vent passage connecting the first vent to the air compartment, the first vent passage extending from the first vent along the first side toward the second end, and along the second end to a first outlet into the air compartment;

a second vent passage connecting the second vent to the air compartment, the second vent passage extending from the second vent along the first end toward the first side, and along the first side toward the second end to a second outlet into the air compartment;

a third vent passage connecting the third vent to the air compartment, the third vent passage extending from the third vent along the second end toward the second side, and along the second side toward the first end to a third outlet into the air compartment; and a fourth vent passage connecting the first vent to the air compartment, the fourth vent passage extending from the fourth vent along the second side toward the first end, and along the first end toward the first side to a fourth outlet into the air compartment.

18. The system of claim 12, further comprising a first air/fluid separator and a second air fluid separator each connected to the storage reservoir, wherein:

the first air/fluid separator includes a first fluid connection for returning separated lubrication fluid to a first fluid return pocket of the storage reservoir and a first air connection for outputting separated air to a first air return pocket of the storage reservoir; and the second air/fluid separator includes a second fluid connection for returning separated lubrication fluid to a second fluid return pocket of the storage reservoir and a second air connection for outputting separated air to a second air return pocket of the storage reservoir.

19. The system of claim 12, wherein the vents of the plurality of vents are located adjacent respective ones of a plurality of corners of the storage reservoir.

* * * * *